US005284045A

United States Patent [19]

Herdzina

[11] Patent Number: 5,284,045

[45] Date of Patent: Feb. 8, 1994

[54] END TOOLING FOR MULTIPLE END DIAMETERS

[75] Inventor: Frank J. Herdzina, South Barrington, Ill.

[73] Assignee: Service Tool International, Inc., Elk Grove Village, Ill.

[21] Appl. No.: 1,256

[22] Filed: Jan. 6, 1993

[51] Int. Cl.[5] ..... B21J 13/00; B21D 37/08

[52] U.S. Cl. ..... 72/477; 413/12; 413/14; 413/56; 413/66

[58] Field of Search ..... 413/12, 14, 15, 16, 413/17, 56, 62, 66, 67; 72/477

[56] References Cited

U.S. PATENT DOCUMENTS

| | | | |
|---|---|---|---|
| 2,349,037 | 5/1944 | Gibbs | 413/56 |
| 3,470,837 | 10/1969 | Fraze et al. | 413/66 |
| 3,580,200 | 5/1971 | Cvacho | 413/14 |
| 3,664,172 | 5/1972 | Cvacho | 413/56 |
| 4,036,160 | 7/1977 | Kelley | 413/12 |
| 4,424,698 | 1/1984 | Langseder | 413/14 |
| 4,848,623 | 7/1989 | Saunders et al. | 413/12 |
| 4,904,140 | 2/1990 | Herdzina et al. | 413/56 |

FOREIGN PATENT DOCUMENTS

| | | | |
|---|---|---|---|
| 2908149 | 9/1979 | Fed. Rep. of Germany | 413/16 |
| 0021481 | 3/1900 | Switzerland | 413/56 |
| 0563812 | 9/1944 | United Kingdom | 413/67 |

*Primary Examiner*—David Jones

*Attorney, Agent, or Firm*—Kinzer, Plyer, Dorn, McEachran & Jambor

[57] ABSTRACT

End tooling for forming easy open can ends has cooperatively-engageable upper and lower tooling defining a plurality of stations. Each station has appropriate punches and dies for progressively converting shells indexed by conveyor into easy open can ends. The tooling is adapted to convert ends of multiple diameters. The punch caps and die caps at each station have cylindrical bodies sized to engage and align a turned edge of a shell. The caps also have one or more arcuate grooves in the end face thereof for receiving the turned edge of ends having a diameter smaller than that of the cap.

8 Claims, 2 Drawing Sheets

END TOOLING FOR MULTIPLE END DIAMETERS

BACKGROUND OF THE INVENTION

This invention relates to presses used to form can ends, and particularly easy-open ends. The ends are used to close food and beverage containers or cans.

Ends are formed in a press equipped with a progressive die. The die has upper and lower tooling defining a plurality of stations. Each station has appropriate punches and/or dies for forming the end. The ends are carried or indexed from station to station by a conveyor belt. The ends are held on the belt by a vacuum box. A ram carries the upper tooling in a reciprocating motion into and out of cooperative engagement with the lower tooling. Details of the press structure are shown and described in U.S. Pat. No. 4,904,140, the disclosure of which is incorporated herein by reference.

The food and beverage containers on which the ends are used come in a wide variety of diameters. Naturally the ends must also be formed to match these multiple diameters. In the past, end tooling has been designed to produce only a single diameter end. If a different size end was needed, all of the tooling had to be changed to accommodate the new size. This was a time consuming operation during which, of course, no ends are produced. The down time is such that small runs of limited production sometimes could not be justified. The owner of a press would sometimes forego a small order than accept the down time needed to run a small job.

The present invention is directed to end tooling which accommodates several or multiple diameters without the need for changing all of the tooling.

SUMMARY OF THE INVENTION

This invention relates to tooling for converting easy-open can ends. A primary object of the invention is tooling for converting ends which makes ends of multiple diameters.

Another object of the invention is end tooling of the type described which increases versatility of existing press equipment by enabling production of multiple end diameters without changing all of the tooling. These and other objects which may appear from time to time in the following specification, drawings and claims are achieved by end tooling having cooperatively-engageable upper and lower tooling mounted on a ram and bolster of a press. The press has a conveyor which transports or indexes shells from one station of the tooling to the next. Shells are unfinished ends having a central panel and a turned edge on the periphery of the panel.

The tooling at each station includes a common locating means engageable with a first portion of an edge of any diameter end. The common locating means aligns the end relative to that station's tools. There is also a first custom locating means for a particular diameter end and a second custom locating means for a second or different diameter end. The first and second custom locating means are circumferentially spaced from the common locating means and are engageable with a second portion of an edge of its particular diameter end for further aligning the end.

In particular, the tooling has punch and die caps which form cylindrical end faces. One outside edge of the cap determines the common locating means. Another outside edge surface of the cap determines one of the custom locating means. An arcuate groove in the end face of the cap determines the other custom locating means. The groove also accommodates the turned edge of ends having a smaller diameter than the cap.

DETAILED DESCRIPTION OF THE INVENTION

Figure 1:
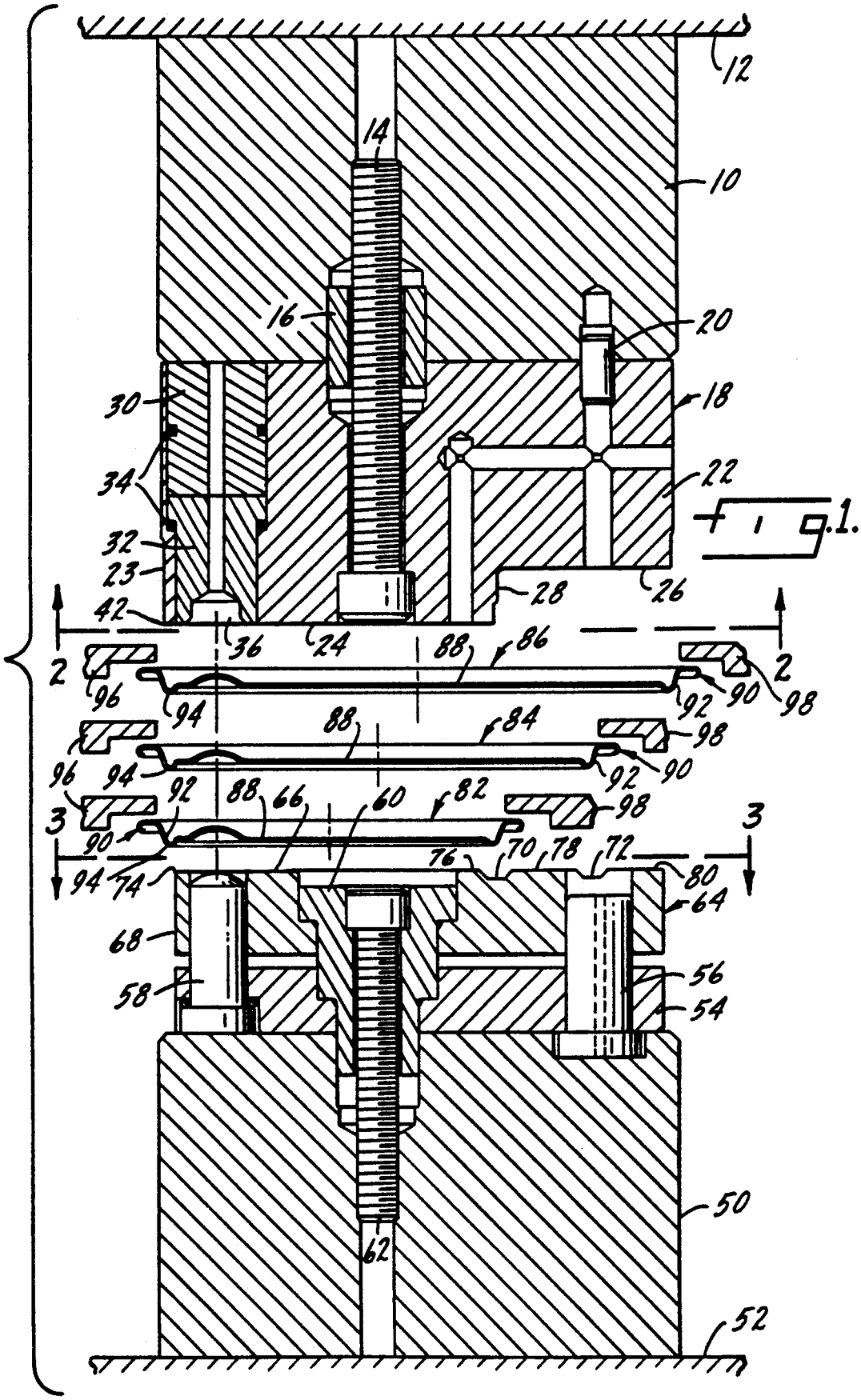
FIG. 1 is a side elevation view with parts in section of the tooling at one station, showing variable end diameters between the upper and lower tooling.

FIG. 1 illustrates the tooling at a station, looking longitudinally of one lane. It will be understood that the complete tooling comprises a plurality of stations, the precise number depending upon the type of end being formed. As an example, one type of end is converted by four rivet form stations, a score station, a panel station, an assembly station for putting a pull tab on, and embossing and checking stations. The station shown in FIG. 1 is the first draw rivet blister station. It will be understood that this is just illustrative of the inventive features, which may be found at each of the stations. Furthermore, more than one lane could be used.

The upper tooling of the station includes a punch holder 10 mounted on a ram 12. The punch cap holder has a threaded opening and counterbore for receiving a bolt 14 and a locating bushing 16 which together attach a punch cap 18 to the punch holder. A locating pin 20 fixes the orientation of the punch cap.

The punch cap comprises a cylindrical body portion 22 having side wall 23 and an end face 24. The end face is undercut at 26 along chord line 28. The punch cap has a bore along one edge which receives a spacer bushing 30 and a punch bushing 32. Both of these bushings have O-ring seals 34. The punch bushing 32 has an opening 36 in the end of it appropriately shaped for drawing a rivet blister.

Figure 2:
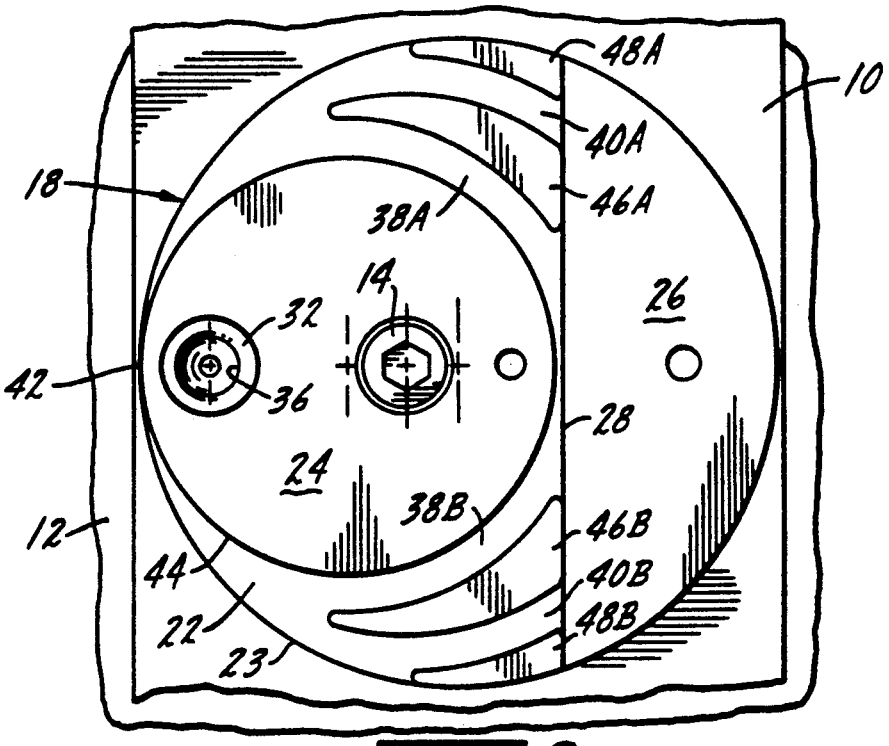
FIG. 2 is a bottom plan view of the upper tooling, looking in the direction of line 2—2 of FIG. 1.

The end face of the punch cap 18 has two arcuate grooves cut therein, as best seen in FIG. 2. The grooves are interrupted by the cutout 26 and are shown as groove segments 38A, 38B and 40A, 40B. The grooves are centered such that the inside diameters of the grooves are tangent with an edge of the end cap, the point of tangency being indicated at 42 in FIG. 2. The tangent point 42 defines a common locating means as further described below. The arcuate grooves 38, 40 define a set of lands including a full circular land 44, a pair of crescent-shaped lands 46A, 46B, a second pair of crescent-shaped lands 48A, 48B. The outer diameters of the lands 44, 46, and 48 define custom locating means as further described below.

Returning now to FIG. 1, the lower tooling includes a die holder 50 resting on a die shoe 52. The holder 50 supports a die spacer 54. The die spacer 54 has openings through which a guide pin 56 extends. Another opening in the die spacer receives a draw pin 58. The draw pin cooperates with the opening 36 in the punch bushing to form the rivet blister. A locating plug 60 extends through the die spacer and is fixed to the die holder 50 by a bolt 62.

The locating plug 60 limits the upward movement of a spring-loaded die cap 64. The die cap has a cylindrical body having an end face 66 and a side wall 68. The end face and side wall intersect at a corner. The die cap 64 is mounted on spring pins (not shown)which extend through the die spacer 54 and into cavities in the die holder 50. These cavities contain springs which urge the spring pins and die cap 64 upwardly against the locating plug 60. The die cap also has openings which receive the guide pin 56 and the draw pin 58.

Figure 3:
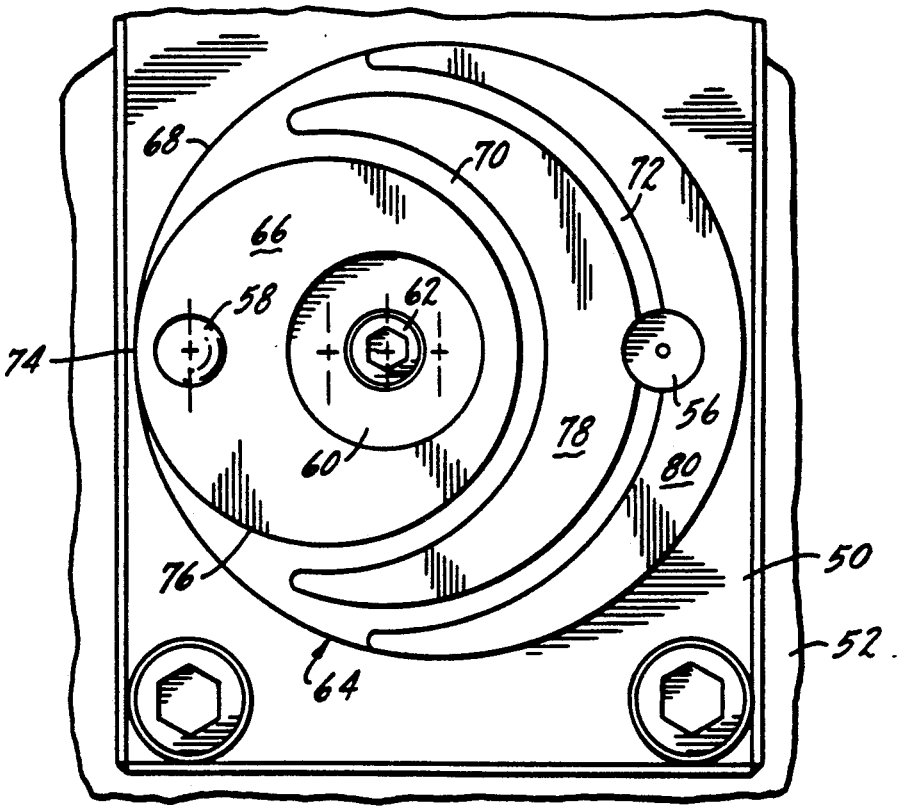
FIG. 3 is a top plan view of the lower tooling, looking in the direction of line 3—3 of FIG. 1.

The end face 66 of the die cap 64 is somewhat similar to that of the punch cap 18 except that there is no cutout. Looking at FIG. 3, the end face 66 has arcuate grooves 70 and 72 whose internal diameters are tangent at a point 74. Arcuate grooves 70 and 72 define a set of lands on the die cap. There is a circular land 76, a first crescent-shaped land 78 and a second crescent-shaped land 80.

Returning again to FIG. 1, three shells 82, 84, and 86 are shown between the upper and lower tooling. Of course, only one size end is made at a time. The drawing merely illustrates how the same tooling can accommodate different diameters. Each shell has a central panel portion 88 and a turned edge 90 which includes a chuck wall or countersink wall 92 and a radius portion 94.

The underside of the edge 90 is supported by a conveyor (not shown) which has generally circular openings about the size of the panel portions 88, allowing the shells to sit down in the openings with the edge 90 supported on the top of the belt. The upper side of the edges 90 are restrained by the vacuum box rails which are shown at 96 and 98. It will be noted that the rail 96 is the same for each size of shell but that the position of the rail 98 must be adjusted for the various shell sizes. Also, note that the cutout 26 in the punch cap accommodates the vacuum box rail 98. It will also be apparent that the conveyor must have openings sized for a particular diameter shell.

The use, operation, and function of the invention are as follows. The tooling operates more or less in the conventional manner for the largest diameter shell 86. When the conveyor has indexed a shell 86 to a station and the downstroke of the ram begins the punch cap 18 moves into contact with the upper side of the shell. Alignment of the shell with the opening 36 is achieved by the common locating means and custom locating means of the punch cap contacting the turned edge of the shell. By common locating means it is meant a portion of the cap which is operative regardless of the diameter of the shell being converted. A custom locating means is one which operates only with a particular diameter of shell.

In the case of the punch cap 18, the common locating means is the tangent point 42 and the portion of the end face 24 and side wall 23 a few degrees on either side of the tangent point. Actually the corner between the side wall and end face engages the upper inside edge of the countersink wall 92 as the punch cap is lowered. The end is further aligned by custom locating means which in the case of the shell 86 are the outside edges of the lands 48A and 48B. These edges also engage the countersink wall so that the shell is supported in three places on the punch cap.

Further downward movement of the ram brings the shell into engagement with the die cap 64. The die cap also has common locating means and custom locating means. In the case of the shell 86, the common locating means on the die cap is the tangent point 74 and a few degrees of the land 76 on either side of point 74. A slight portion of the side wall 68 and the corner between the side wall and end face 66 engages the underside of the depending radius 94 to locate the shell with respect to the draw pin 58. The custom locating means for shell 86 is the outer edge surface of land 80. This arcuate surface also engages the underside of the depending radius 94 to assure proper location of the shell prior to the die cap bottoming on the die spacer, at which point the drawing operation occurs. Once the return stroke of the ram has pulled the punch cap off of the shell, the conveyor indexes the shells to the next station.

When it is desired to make a different diameter end, the machine is set up as follows. One vacuum box rail 98 is relocated or changed to match the diameter of the new shells. The conveyor belt is also changed. Downstackers, cutoff knives and guides are changed to handle the new diameter. The panel station and score station tooling is changed but that is all that has to be done. This is compared with prior art tooling that required everything to be changed when the diameter changed.

Consider now how the alignment of the new diameter shells will take place. Say for example the end size now being made is that of shells 84. As the punch cap is lowered the common locating means 42 will again engage the countersink wall 92 of shell 84. But the custom locating means will change to the outer surfaces of the lands 46A, 46B. The arcuate grooves 40A and 40B will accommodate the upwardly extending countersink wall. When the shell 84 contacts the die cap 64 it will be aligned by the common locating means 74 and the custom locating means, which, in this case, would comprise the outside edge of the land 78. The groove 72 accommodates the depending radius portion 94 of the shell.

The situation is similar with respect to the smallest diameter end. Again, the common locating points 42 and 74 are involved in aligning the shell 82. The custom locating means in both the upper and lower tooling for the smallest end diameter comprise a complete circle of the lands 44 and 76. Thus, the smallest end is supported all the way around rather than in segments as is the case with the larger diameters. In any event, it can be seen that ends of variable diameters are aligned and supported for conversion, without changing the tooling at every station.

While a preferred form of the invention has been shown and described, it will be realized that alterations could be made thereto without departing from the scope of the following claims. For example, the tooling could be arranged to handle more or less than the three different diameters shown. Or the custom locating means could be a set of locating pins or the like, instead of the crescent-shaped lands shown.

I claim:

1. End tooling of the type comprising cooperatively-engageable, reciprocable upper and lower tooling defining a plurality of stations having tools which progressively convert shells indexed by a conveyor into can ends, the ends having a central panel and a turned edge on the periphery of the panel, the improvement comprising tooling for converting ends of multiple diameters, the tooling comprising at each station a common locating means engageable with a first portion of an edge of any diameter end for aligning the end relative to that station's tools, at least one first custom locating means for a first particular diameter end to be converted, and at least one second custom locating means for a second particular diameter end to be converted, the custom locating means being circumferentially spaced from the common locating means and engageable with a second portion of an edge of its particular diameter end for further aligning said end.

2. The tooling of claim 1 further characterized in that a common locating means and at least one first and second custom locating means are formed on both the lower tooling and upper tooling of at least one station.

3. The tooling of claim 1 further comprising a cylindrical cap at each station on one of the upper or lower tooling, the cap having a side wall and end face joined at a corner, a first circumferential portion of one or both of the side wall and corner determining the common locating means, a second circumferential portion of one or both of the side wall and corner determining one of the custom locating means, and at least one arcuate groove in the end face tangent with the common locating means and of a particular diameter to determine the other custom locating means.

4. The tooling of claim 3 wherein the cylindrical cap has an undercut portion generally opposite the common locating means.

5. The tooling of claim 1 wherein one of the upper or lower tooling at each station has an undercut portion generally opposite the common locating means.

6. A punch or die cap for end tooling, comprising:

a cylindrical body having a side wall, an end face and a corner at the intersection of the side wall and end face; and at least one arcuate groove in the end face tangent with said side wall of the body and extending at least partially across the end face, such that at least a portion of the groove is remote from the side wall.

7. The punch or die cap of claim 6 further comprising a chordal undercut portion on the end face.

8. In end tooling of the type comprising cooperatively-engageable reciprocable upper and lower tooling defining a plurality of stations having tools which progressively convert shells indexed by a conveyor into can ends, the ends having a central panel and a turned edge on the periphery of the panel, the end being generally circular and having a diameter, an improved method of aligning shells of multiple diameters relative to the station tools, comprising the steps of:

providing a common alignment means at each station for aligning ends relative to the station tools;

providing at least two custom alignment means at each station for aligning ends of different diameters;

fixing the position of one edge portion of an end at the common alignment means, regardless of the end's diameter; and fixing the position of another edge portion of an end at one of the custom alignment means which is specific to that particular end's diameter.

* * * * *